US008071868B2

(12) United States Patent
Dennis

(10) Patent No.: US 8,071,868 B2
(45) Date of Patent: Dec. 6, 2011

(54) MUSICAL INSTRUMENT VIBRATO MOUNTING ADAPTER APPARATUS

(75) Inventor: Terrance Dennis, Ringoes, NJ (US)

(73) Assignee: U.E. Corp., Ringoes, NJ (US)

( * ) Notice: Subject to any disclaimer, the term of this patent is extended or adjusted under 35 U.S.C. 154(b) by 26 days.

(21) Appl. No.: 12/836,730

(22) Filed: Jul. 15, 2010

(65) Prior Publication Data

US 2010/0282042 A1 Nov. 11, 2010

Related U.S. Application Data

(63) Continuation-in-part of application No. 12/500,708, filed on Jul. 10, 2009, now Pat. No. 7,812,232.

(60) Provisional application No. 61/134,961, filed on Jul. 15, 2008.

(51) Int. Cl.
*G10D 3/00* (2006.01)

(52) U.S. Cl. ..... 84/313

(58) Field of Classification Search ..... 84/312 R, 84/313, 290, 299–302
See application file for complete search history.

(56) References Cited

U.S. PATENT DOCUMENTS

| | | | | |
|---|---|---|---|---|
| 2,949,806 | A | 8/1960 | Turman | |
| 3,990,341 | A | 11/1976 | Pace | |
| 4,497,236 | A | 2/1985 | Rose | |
| 4,535,670 | A | 8/1985 | Borisoff | |
| 4,632,005 | A | 12/1986 | Steinberger | |
| 5,567,897 | A | 10/1996 | McEwen | |
| D605,687 | S | 12/2009 | Dennis | |
| 7,696,420 | B2 * | 4/2010 | Thompson | 84/313 |
| 7,709,713 | B1 | 5/2010 | Pearce | |
| 2006/0075879 | A1 | 4/2006 | Ushinski | |
| 2010/0011936 | A1 | 1/2010 | Dennis | |

* cited by examiner

*Primary Examiner* — Kimberly Lockett
(74) *Attorney, Agent, or Firm* — Lawrence Lambelet, Jr.

(57) ABSTRACT

A vibrato mounting apparatus for mounting a vibrato device, such as a Bigsby Vibrato, to an electric guitar without making changes to the guitar body is herein disclosed. The vibrato device replaces the stop tailpiece of the guitar leaving available mounting holes for the mounting apparatus. The vibrato device is then mounted to the apparatus without the need to alter the guitar by drilling holes. The mounting apparatus locates the vibrato device on the guitar in a manner to maintain the critical bend angle of the guitar strings over the bridge. With a minimalist profile, the mounting apparatus is essentially concealed from view and presents a small burden in weight to the guitar. An alternative embodiment provides a method for mounting the apparatus so as to preserve the design string dynamics.

10 Claims, 2 Drawing Sheets

MUSICAL INSTRUMENT VIBRATO MOUNTING ADAPTER APPARATUS

CROSS-REFERENCE TO RELATED APPLICATIONS

This is a Continuation-in-Part application claiming priority to U.S. Non-Provisional Application Ser. No. 12/500,708, filed Jul. 10, 2009, and to U.S. Provisional Application No. 61/134,961, filed Jul. 15, 2008, the two of which are incorporated herein by reference.

FIELD OF THE INVENTION

The present invention deals generally with the field of musical instruments and more specifically with guitars and further specifically with electric guitars.

BACKGROUND OF THE INVENTION

Many electric guitars include a guitar stop tailpiece to which the guitar strings are attached near the lowermost end of the guitar. It is common practice to remove a guitar stop tailpiece and replace it with a vibrato or tremolo, also commonly called a whammy bar, for the purpose of providing unique sounds while playing the guitar.

Vibrato mechanisms provide a means for changing the tension on all the strings of a guitar simultaneously. Changing the tension creates a pitch change in each vibrating string. This is accomplished by a moving tailpiece which pivots about an axis substantially perpendicular to the strings. A handle is provided to facilitate a pulse-like pivoting of the tailpiece while simultaneously playing the instrument.

Most vibrato devices are retrofitted to guitars. This involves either routing out an internal space for part of the mechanism, such as balancing springs, or otherwise drilling mounting holes to secure the device to the guitar body. In both cases, the guitar is permanently defaced and its resale value compromised. Furthermore, changing vibrato devices, or removing the device, leaves unsightly vestiges of the former mounting. It is no wonder that many guitar owners are hesitant to mount such devices.

There are numerous examples of vibrato devices and like mechanisms in the prior art. Two of these, which characterize the genre, are U.S. Pat. No. 4,497,236 to Rose and U.S. Pat. No. 4,632,005 to Steinberger.

The Bigsby® Vibrato is the ubiquitous after-market device. In a particular type of Bigsby Vibrato device, the type having a hinged plate connecting to the strap anchor at the side of the body of the guitar, the procedure for mounting involves removing the stop tailpiece, typically found on guitars with a Tune-O-Matic® style bridge. The device is then mounted to the top surface of the guitar body with two screws while the hinged plate is mounted to the side surface with four screws, the hinged plate accommodating a strap anchor screw there through an aperture. The mounting requires new holes in the guitar for the particular fastener layout. It would be desirable to accomplish the mounting without drilling new holes. What is needed and missing in the prior art is a mounting adapter for a vibrato device, and specifically a Bigsby Vibrato device of the hinged type aforementioned, which utilizes the screw holes vacated by the removal of the stop tailpiece and the strap anchor.

Furthermore, it would be desirable, when mounting the vibrato device, to effectively replace the stop tailpiece without changing the angle of the bend of the strings over the bridge. This bend effectively holds the location of an individual string in its saddle on the bridge and the angle determines the sufficient amount of downward pull required to stabilize the configuration. If the angle is too shallow, the string may drift from its saddle location and cause it to go out of tune. The angle could become too shallow if the vibrato device is located too far rearward of the bridge.

Additionally, if the hold-down bar of the vibrato device is not located at the position of the stop-tailpiece, the dynamic of the strings could be changed from that of the original design, potentially compromising the tonal quality of the instrument. The angle of bend over the bridge creates certain forces that act both on the top surface of the guitar and on the strings themselves. The resultant of those forces defines the vibratory modes and resonance qualities of the guitar. A musician with an ear for his or her particular instrument would not want to drift from the delicate balance achieved by the artisan designer. A mounting adapter apparatus of preferred design, therefore, would locate the hold-down bar of the vibrato device to replicate the original string dynamics defined by the stop tailpiece.

The present invention provides an adapter apparatus having a first plate to mount with the stop tailpiece screws and a second plate to mount with the strap anchor screw. Both plates have pre-drilled holes to receive the mounting screws of a vibrato device having a hinged member downwardly articulated to cover the strap anchor location. The vibrato device can be mounted flush with the adapter apparatus when screws substituting for the stop tailpiece are counter sunk to the plate surface. The flush mounting and the positioning of the device over the apparatus, as defined by the pre-drilled holes, allow for optimal mounting with respect to the preferred location previously occupied by the stop tailpiece. Footpads, or bumpers, beneath the plates are used to protect the finished surfaces of the guitar.

The adapter apparatus of the present invention is comprised of two plates to minimize the footprint on the guitar. As a matter of fact, the plates themselves are of minimal area to cause them to be essentially hidden beneath the vibrato device. In avoiding over-sizing a plate, or plates, the added weight of the installation is thereby reduced. Furthermore, the concealment of the apparatus gives the appearance of a factory installment.

SUMMARY OF THE INVENTION

A first object of the present invention is to provide a simple and effective means for securing a vibrato device from one of many different manufacturers to a musical instrument such as a guitar.

A second object of the present invention is to provide a means for mounting a vibrato device to a guitar body by utilizing existing mounting holes provided therein.

A third object of the present invention is to provide a means for mounting the vibrato device without requiring additional drilling or any permanent change to the configuration of either the musical instrument or the vibrato device.

A fourth object of the present invention is to provide a mounting apparatus that is concealed from view and notice when mounted beneath the vibrato device.

A fifth object of the present invention is to provide an apparatus which is of minimal cost and avoids moving parts.

A sixth object of the present invention is to provide an apparatus which is easy to manufacture, efficient of material use and simple to install.

A seventh object of the present invention is to provide an apparatus including countersunk mounting holes to facilitate flush mounting of a vibrato device thereto.

An eighth object of the present invention is to provide a means for mounting which includes only two secure mounting points for the top surface plate and one for the side surface plate, which map to pre-existing mounting holes in a preferred guitar.

A ninth object of the present invention is to provide an apparatus that precludes any permanent modification of the host musical instrument.

A tenth object of the present invention is to preserve the original string dynamics of the instrument.

An eleventh object of the present invention is to provide a means for optimizing the angle of bend of the strings over the bridge.

These objects, and others to become hereinafter apparent, are embodied in an apparatus to mount a vibrato device to a guitar having stop tailpiece mounting holes and a strap anchor mounting hole, the vibrato device having forward mounting apertures on a horizontal member and rearward mounting apertures on a vertical member hinge-ably attached to the horizontal member. The apparatus comprises a first plate adapted to mount to the guitar by means of the stop tailpiece mounting holes, the first plate having mounting apertures there through corresponding to the forward mounting apertures of the vibrato device. The apparatus further comprises a second plate adapted to mount by means of the strap anchor mounting hole, the second plate having mounting apertures there through corresponding to the rearward mounting apertures of the vibrato device. The vibrato device, when mounted to the first plate and the second plate, thusly avoids the drilling of new holes in the guitar.

In a preferred embodiment, the vibrato device further comprises a string hold-down bar and the first plate mounting apertures position the string hold-down bar at the location on the guitar formerly occupied by the stop tailpiece. In doing so, the string dynamics of the original design are replicated.

In a particularly preferred embodiment, the outlines of the first plate and second plate fit within the outline of the vibrato device and are drawn to extend only marginally beyond the mounting apertures. In doing so, the added weight to the guitar is minimized and the plates are concealed from view.

In an alternate embodiment, a method of mounting the vibrato device described above to a guitar having a bridge, comprises the steps of providing the first plate and the second plate as also described above; removing the stop tailpiece from the guitar; removing the guitar strings from the stop tailpiece; removing the strap anchor from the guitar; mounting the first plate to the stop tailpiece mounting holes; mounting the second plate to the strap anchor mounting hole; mounting the vibrato device to the first plate and the second plate so as to position the hold-down bar at a location preserving the original vertical angle of the strings relative to the bridge; and restringing the guitar strings to the vibrato device. The method results in positioning the vibrato device so as to preserve the design dynamic of the strings and avoids, by utilization of the mounting apertures provided in the plates, any permanent modification to the instrument.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
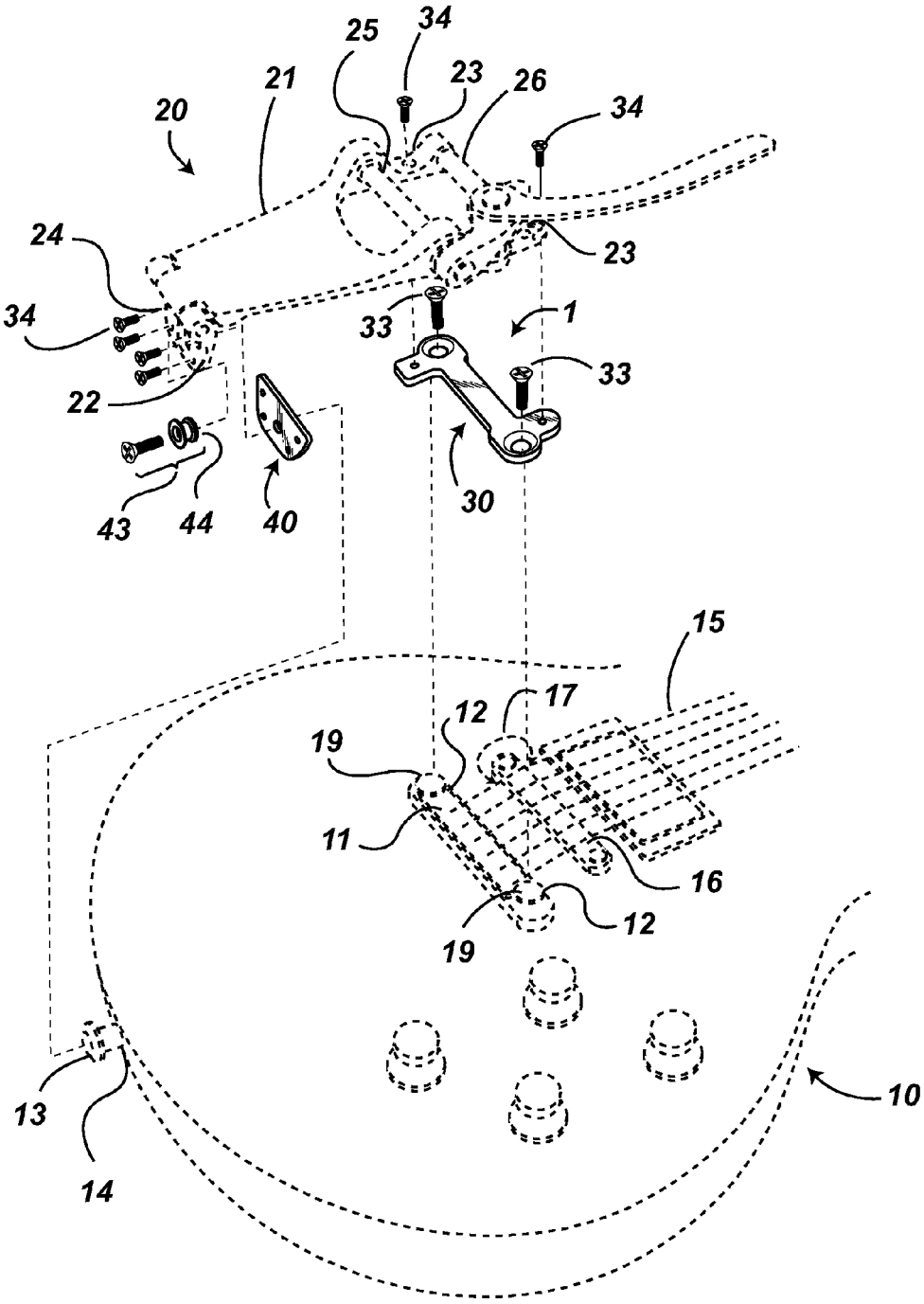
FIG. 1 is an exploded perspective view of the present invention with a Bigsby vibrato device and a Les Paul® guitar shown in dashed line.
Figure 5:
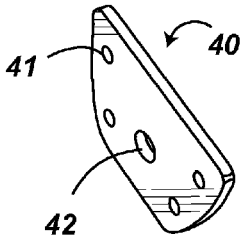
FIG. 5 is a perspective view of the second plate of the mounting apparatus.
Figure 2:
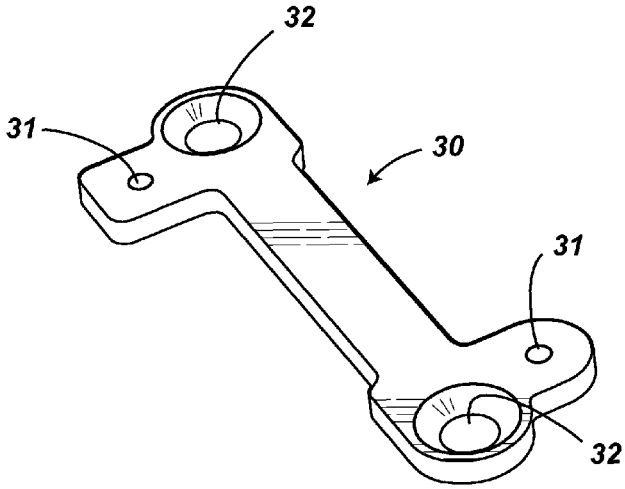
FIG. 2 is a perspective view of the first plate of the mounting apparatus.
Figure 6:
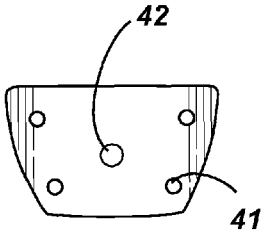
FIG. 6 is a plan view of the second plate.
Figure 3:
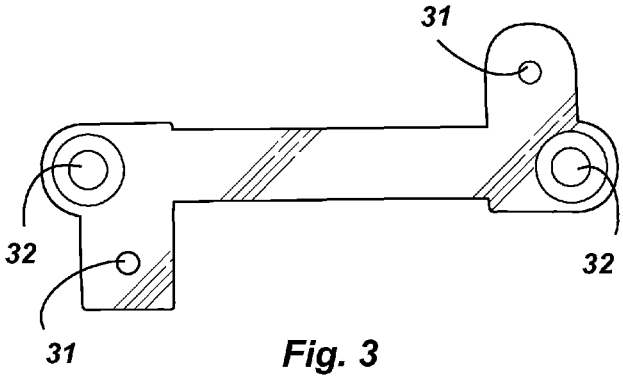
FIG. 3 is a plan view of the first plate.

As shown in FIG. 1, the present invention provides a vibrato mounting apparatus 1 designed to be secured to guitar 10 to facilitate mounting of a vibrato device 20 with respect thereto. In the preferred embodiment, the vibrato device 20 is a Bigsby Vibrato B7.

Normally, a guitar 10 includes, inter alia, a stop tailpiece 11 and a strap anchor 13. A plurality of guitar strings 15 terminate at the stop tailpiece 11 and one end of the guitar shoulder strap 18 (not shown) is attached at the strap anchor 13. The guitar strings 15 form a downward bend over a bridge 16 before stringing to an end at the stop tailpiece 11. The strings form a vertical angle 17 with said bridge. Stop tailpiece screws 19 and the strap anchor 13 can be removed from guitar 10 to dismount the stop tailpiece 11 and shoulder strap 18 and, in so doing, reveal treaded stop tailpiece mounting holes 12 and a strap anchor mounting hole 14. These mounting holes provide a means for mounting the vibrato device 20 without drilling new holes in the body of guitar 10, said means in utilization of the mounting apparatus 1.

The vibrato device 20 is comprised of a horizontal member 21 and a vertical member 22 hinge-ably attached thereto. The vertical member is designed to mount to the rear side surface of guitar 10 at the location of the strap anchor 13. The strap anchor 13 is accommodated through an aperture in the vertical member 22. The horizontal member 21 is designed to mount to the top surface of guitar 10. The mounting of the horizontal and vertical members typically involves drilling holes in the top and side surfaces for receiving mounting screws. The screws typically number two for horizontal member and four for the vertical member.

The horizontal member 21 is comprised, inter alia, of a roller bar 25 and a string hold-down bar 26. The strings 15 are terminated at the roller bar 25 after passing underneath the string hold-down bar 26. The roller bar 25 pivots about a horizontal axis to effect pitch change in the strings. The hold-down bar 26 acts to create a bend in the strings over the bridge 16. The bend serves to keep the strings in location on the bridge. When the string-hold down bar 26 is placed appropriately, through positioning of the horizontal member 21, the string-hold down bar 26 can act in place of the stop tailpiece 11 and, in so doing, replicate the string vertical angle 17.

Referring to FIGS. 2-7, the mounting apparatus 1 is comprised of a first plate 30 and a second plate 40. The first plate 30 has a pair of first plate holes 32 corresponding to the stop tailpiece mounting holes 12. In the preferred embodiment, the first plate holes 32 are counter-sunk to allow flush mounting of the vibrato device 20. The second plate 40 has a second plate hole 42 corresponding to the strap anchor mounting hole 14. The first plate 30 and the second plate 40 can be mounted to guitar 10 by means of the first plate holes 32 and the second plate hole 42. The first plate 30 and the second plate 40 also have, respectively, first plate mounting apertures 31 corresponding to the forward mounting apertures 23 and second plate mounting apertures 41 corresponding to the rearward mounting apertures 24 of the vibrato device 20. The vibrato device 20 can be mounted to the top and side surfaces of guitar 10 by means of the first plate mounting apertures 31 and the second plate mounting apertures 41.

The positioning of the first plate mounting apertures 31 on the first plate 30 is such that the hold-down bar 26 of the vibrato device 20 is located in the position of the stop tailpiece 11 when the first plate 30 is mounted to the stop tailpiece mounting holes 12. This preferred positioning forms the string vertical angle 17 over the bridge 16 and, in so doing, preserves the original string dynamics. It also provides sufficient holding force to keep the strings in place on the bridge. Should this positioning create a gap at the vertical member 22, the gap can be shimmed with a spacer component.

The two-plate design of the mounting apparatus 1 eliminates added weight to the guitar 10 while reducing dampening by avoiding additional contact to the guitar's resonant face. This minimization of contact surface is furthered by reducing the plate outlines to the functional limit. That limit is defined by the first plate mounting apertures 31 and the second plate mounting apertures 41. The reduction of outlines also essentially conceals the first plate 30 beneath the horizontal member 21 and the second plate 40 beneath the vertical member 22. When the vibrato device 20 is mounted to the mounting apparatus 1, it appears as if it were mounted directly to the guitar 10 (thereby eliminating the look of a retrofit).

Figure 7:
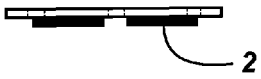
FIG. 7 is an elevation view of the second plate.
Figure 4:
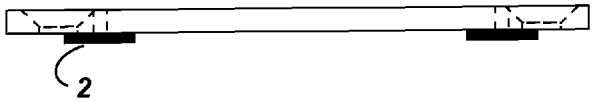
FIG. 4 is an elevation view of the first plate.

Referring to FIGS. 4 and 7, the first plate 30 and the second plate 40 are provided with non-abrasive pads 2 to protect the lacquered, or otherwise polished, finish of the guitar 10. The non-abrasive pads 2 are preferably of a soft and compressible material, such as felt or rubber. The pads can be attached with pressure-sensitive adhesive or by other known means.

In the preferred embodiment, the first plate 30 is provided with plate screws 33, as shown in FIG. 1. The plate screws 33 are adapted for flush mounting in the counter-sunk first holes 32 before threading to the stop tailpiece mounting holes 12. The second plate 40 is similarly provided with a substitute strap anchor 43. The substitute strap anchor 43 mounts to the strap anchor mounting hole 14 with a flange 44 to hold the second plate 40 in place. The first plate 30 and the second plate 40 are additionally provided with a set of vibrato screws 34 which correspond to the forward mounting apertures 23 and the rearward mounting apertures 24, in which they serve to fasten the vibrato device 20 to the mounting apparatus 1.

The first plate 30 and the second plate 40 can be fabricated by cutting from plate stock comprised of any metal, by foundry casting, by thermoplastic injection molding, or by thermoset sheet-molding. In the preferred embodiment, the plates are cut from 3/16 inch aluminum plate and surfaces can be anodized or brushed for a finished appearance. The first plate holes 32 and the second plate hole 42 are matched to the corresponding stop tailpiece mounting holes 12 and strap anchor mounting hole 14 and are drilled through to provide clearance for the plate screws 33 and the substitute strap anchor 43. The first plate mounting apertures 31 and the second plate mounting apertures 41 are drilled and tapped to receive the vibrato screws 34.

In an alternate embodiment, a method of mounting a vibrato device 20 to a guitar 10 having strings 15, a bridge 16, a stop tailpiece 11, stop tailpiece mounting holes 12, a strap anchor 13 and a strap anchor mounting hole 14, the vibrato device 20 having forward mounting apertures 23 on a horizontal member 21 and rearward mounting apertures 24 on a vertical member 22 hinge-ably attached to the horizontal member 21, the vibrato device 20 further having a string hold-down bar 26, the method comprising the steps:

a. providing a first plate 30 adapted to mount to the guitar 10 by means of the stop tailpiece mounting holes 12, the first plate 30 having first plate mounting apertures 31 there through corresponding to the forward mounting apertures 23 of the vibrato device 20; and a second plate 40 adapted to mount by means of the strap anchor mounting hole 14, the second plate 40 having second plate mounting apertures 41 there through corresponding to the rearward mounting apertures 24 of the vibrato device 20;

b. removing the stop tailpiece 11 from the guitar 10;

c. removing the guitar strings 15 from the stop tailpiece 11;

d. removing the strap anchor 13 from the guitar 10;

e. mounting the first plate 30 to the stop tailpiece mounting holes 12;

f. mounting the second plate to the strap anchor mounting hole 14;

g. mounting the vibrato device 20 to the first plate 30 and the second plate 40 so as to position the hold-down bar 26 at a location preserving an original vertical angle 17 of the strings 15 relative to the bridge 16; and h. restringing the guitar strings 15 to the vibrato device 20;

i. whereas the positioning of the vibrato device maintains the design dynamic of the strings.

It should be appreciated that the vibrato mounting apparatus of the present invention has been designed for the specific purpose of providing a simple and effective means for securing a vibrato device to a guitar. This mounting apparatus can be used with any brand vibrato but is particularly usable with those vibratos manufactured by Bigsby. The mounting apparatus can similarly be used with any guitar but is particularly usable with those having a Tune-O-Matic style bridge. The use of the existing mounting holes of the musical instrument minimizes damage to the instrument and allows the vibrato device to be removed at any time without leaving witness markings. The trim profile of the design renders the mounting apparatus essentially invisible once the vibrato device is mounted in place.

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of the description and should not be regarded as limiting.

What is claimed is:

1. An apparatus to mount a vibrato device to a guitar having stop tailpiece mounting holes and a strap anchor mounting hole, the vibrato device having forward mounting apertures on a horizontal member and rearward mounting apertures on a vertical member hinge-ably attached to the horizontal member, comprising:

a first plate adapted to mount to the guitar by means of the stop tailpiece mounting holes, the first plate having mounting apertures there through corresponding to the forward mounting apertures of the vibrato device; and a second plate adapted to mount by means of the strap anchor mounting hole, the second plate having mounting apertures there through corresponding to the rearward mounting apertures of the vibrato device;

whereas the vibrato device mounted to the first plate and the second plate avoids drilling new holes in the guitar.

2. The apparatus of claim 1, wherein the vibrato device further comprises a string hold-down bar and the first plate mounting apertures position the string hold-down bar at the location on the guitar formerly occupied by the stop tailpiece.

3. The apparatus of claim 1, wherein the outlines of the first plate and second plate fit within the outline of the vibrato device and are drawn to extend only marginally beyond the mounting apertures.

4. The apparatus of claim 1, wherein the first plate is adapted to mount to the guitar by means of counter-sunk holes aligned with the stop tailpiece mounting holes, the counter-sinking thereof allowing for the flush mounting of the vibrato device.

5. The apparatus of claim 1, wherein the first plate and the second plate are furnished with a plurality of non-abrasive pads there under to protect the guitar finish.

6. A method of mounting a vibrato device to a guitar having strings, a bridge, a stop tailpiece with stop tailpiece mounting holes and a strap anchor with a strap anchor mounting hole, the vibrato device having forward mounting apertures on a horizontal member and rearward mounting apertures on a vertical member hinge-ably attached to the horizontal member, the vibrato device further having a string hold-down bar, the method comprising the steps:

providing a first plate adapted to mount to the guitar by means of the stop tailpiece mounting holes, the first plate having mounting apertures there through corresponding to the forward mounting apertures of the vibrato device; and a second plate adapted to mount by means of the strap anchor mounting hole, the second plate having mounting apertures there through corresponding to the rearward mounting apertures of the vibrato device;

removing the stop tailpiece from the guitar;

removing the guitar strings from the stop tailpiece;

removing the strap anchor from the guitar;

mounting the first plate to the stop tailpiece mounting holes;

mounting the second plate to the strap anchor mounting hole;

mounting the vibrato device to the first plate and the second plate so as to position the hold-down bar at a location preserving the original vertical angle of the strings relative to the bridge; and restringing the guitar strings to the vibrato device;

whereas the positioning of the vibrato device maintains the design dynamic of the strings.

7. The method of claim 6, wherein the step of mounting the vibrato device to the first plate and the second plate comprises the utilization of the mounting apertures of the first and second plates to thereby avoid any permanent alteration to the guitar.

8. The method of claim 6, wherein the step of providing a first plate and a second plate further comprises sizing the first and second plates to only marginally extend beyond the respective mounting apertures, the minimization thereby avoiding added weight to the guitar while providing concealment of the utility thereof.

9. The method of claim 6, further comprising the step of providing plate screws compatible with the stop tailpiece mounting holes, the screws adapted to fit flush within corresponding counter-sunk holes in the first plate.

10. The method of claim 6, further comprising the step of providing vibrato screws for the mounting apertures of the first and second plates.

* * * * *